US008887463B2

(12) United States Patent
Derrigan et al.

(10) Patent No.: US 8,887,463 B2
(45) Date of Patent: Nov. 18, 2014

(54) COVER ASSEMBLY FOR STRUCTURAL MEMBERS

(75) Inventors: James Derrigan, Tonawanda, NY (US); Chris Wierzbowski, Cheektowaga, NY (US)

(73) Assignee: Construction Research & Technology GmbH, Trostberg (DE)

( * ) Notice: Subject to any disclaimer, the term of this patent is extended or adjusted under 35 U.S.C. 154(b) by 879 days.

(21) Appl. No.: 11/943,986

(22) Filed: Nov. 21, 2007

(65) Prior Publication Data

US 2008/0127590 A1 Jun. 5, 2008

Related U.S. Application Data

(60) Provisional application No. 60/860,663, filed on Nov. 22, 2006.

(51) Int. Cl.

| | |
|---|---|
| ***E04B 1/62*** | (2006.01) |
| ***E04B 1/343*** | (2006.01) |
| ***E02D 29/14*** | (2006.01) |
| ***E01C 11/00*** | (2006.01) |
| ***E01C 23/02*** | (2006.01) |
| ***E02D 17/10*** | (2006.01) |

(52) U.S. Cl.

CPC ..... *E02D 17/10* (2013.01)
USPC ..... 52/395; 52/393; 52/394; 52/573.1; 404/25; 404/47; 404/87

(58) Field of Classification Search

USPC ..... 52/393–394, 573.1; 404/25, 47, 87
See application file for complete search history.

(56) References Cited

U.S. PATENT DOCUMENTS

| | | | | |
|---|---|---|---|---|
| 3,363,522 | A | | 1/1968 | Galbreath |
| 3,435,574 | A | | 4/1969 | Hallock |
| 3,659,390 | A | | 5/1972 | Balzer et al. |
| 3,696,575 | A | | 10/1972 | Armstrong |
| 3,745,726 | A | * | 7/1973 | Thom et al. ..... 52/98 |
| 3,758,220 | A | | 9/1973 | Hein |
| 3,779,660 | A | * | 12/1973 | McGeary et al. ..... 404/69 |
| 3,810,707 | A | | 5/1974 | Tungseth et al. |
| 3,849,958 | A | | 11/1974 | Balzer et al. |
| 3,862,810 | A | | 1/1975 | Welch |
| 3,899,261 | A | | 8/1975 | Mieville |
| 3,974,609 | A | | 8/1976 | Attaway |
| 3,974,614 | A | | 8/1976 | Strong |
| 4,022,538 | A | | 5/1977 | Watson et al. |
| 4,067,155 | A | | 1/1978 | Ruff et al. |
| 4,184,298 | A | | 1/1980 | Balzer et al. |

(Continued)

FOREIGN PATENT DOCUMENTS

| | | |
|---|---|---|
| JP | 6-322848 | 11/1994 |
| JP | 6-622849 | 11/1994 |

*Primary Examiner* — Brian Glessner
*Assistant Examiner* — Omar Hijaz
(74) *Attorney, Agent, or Firm* — Curatolo Sidoti Co., LPA; Salvatore A. Sidoti; Daniel E. Moderick, Jr.

(57) ABSTRACT

A cover assembly for bridging an opening located in an expansion joint between two spaced-apart structural members. The cover assembly includes a coverplate having a rigid plate member that is engaged with a resilient elastomeric cover. The cover assembly is affixed to the underlying structural members by base members. The proper positioning of the cover assembly within the expansion joint gap is maintained through a positioning assembly that is engaged with the coverplate and base members.

28 Claims, 3 Drawing Sheets

(56) References Cited

U.S. PATENT DOCUMENTS

| | | | | |
|---|---|---|---|---|
| 4,271,650 | A | | 6/1981 | Lynn-Jones |
| 4,307,974 | A | | 12/1981 | George |
| 4,411,582 | A | | 10/1983 | Nakada |
| 4,654,245 | A | | 3/1987 | Balzer et al. |
| 4,706,318 | A | | 11/1987 | Huber et al. |
| 4,815,247 | A | | 3/1989 | Nicholas et al. |
| 4,876,759 | A | | 10/1989 | Yang |
| 5,020,294 | A | | 6/1991 | Duda |
| 5,024,554 | A | | 6/1991 | Benneyworth et al. |
| 5,048,249 | A | | 9/1991 | Shreiner et al. |
| 5,060,439 | A | | 10/1991 | Clements et al. |
| 5,067,297 | A | | 11/1991 | Sobol |
| 5,078,529 | A | * | 1/1992 | Moulton ..... 403/24 |
| 5,082,394 | A | | 1/1992 | George |
| 5,092,094 | A | | 3/1992 | Duda et al. |
| 5,211,505 | A | | 5/1993 | Ueda |
| 5,263,293 | A | | 11/1993 | Gohlke et al. |
| 5,269,624 | A | | 12/1993 | Kramer |
| 5,644,879 | A | | 7/1997 | Shreiner et al. |
| 5,791,111 | A | | 8/1998 | Beenders |
| 5,799,456 | A | | 9/1998 | Shreiner et al. |
| 5,887,400 | A | | 3/1999 | Bratek et al. |
| 5,888,017 | A | | 3/1999 | Corrie |
| 5,911,662 | A | | 6/1999 | Hallsten |
| 6,112,488 | A | | 9/2000 | Olson et al. |
| 6,751,918 | B2 | * | 6/2004 | Jesko ..... 52/393 |
| 6,751,919 | B2 | | 6/2004 | Calixto |

* cited by examiner

COVER ASSEMBLY FOR STRUCTURAL MEMBERS

CROSS REFERENCE TO RELATED APPLICATIONS

The present application claims the benefit of the filing date under 35 U.S.C. 119(e) of U.S. Provisional Application for Patent Ser. No. 60/860,663, filed Nov. 22, 2006, which is hereby incorporated by reference.

TECHNICAL FIELD

Disclosed is a protective cover assembly for placement over an opening between adjacent horizontal structures. The protective cover assembly spans a gap or opening between two spaced-apart adjacent horizontal concrete structures. The protective cover assembly permits a smooth transition of pedestrian or vehicular traffic across the gap between the adjacent horizontal concrete structures.

BACKGROUND

An expansion joint is a gap that is purposely provided between adjacent concrete structures for accommodating dimensional changes to the adjacent concrete structures occurring as expansion and contraction due to temperature changes, seismic cycling, and vibration. An expansion joint may be damaged by the ingress of water and debris, by abrasion, and by shear, tensile and compression forces generated by the passage of motorized vehicular traffic across the joint.

Elongated metal plates placed in an end-to-end relationship have been bolted to concrete structures in an attempt to protect the expansion joint from damage due to pedestrian and vehicular traffic. Often, the metal plates become deformed and do not form a uniform seated engagement with concrete structures, particularly where the traffic bearing upper surfaces of the adjacent concrete structures are irregular or undulating and therefore fail to provide the necessary uniform planar support for the metal plates. Under these conditions, the metal plates are bent and distorted due to impact loading of traffic and acquire a state of looseness about their mounting bolts which degrades further when the mounting bolts bend or break. Even before the metal plates become disjointed from the mounting bolts, the metal plates generate an annoying noise with each deflection against the adjoining concrete structures.

Additionally, it is widely known that the surfaces of concrete structural members are not always entirely uniform, and are often not produced with square or smooth surfaces. These concrete structural members are usually rough, often have substantially irregular or undulating gaps, or are missing entire chunks of concrete. Furthermore, there is often a vertical offset between two structural members, due to the settlement of concrete.

Therefore, a need exists in the art for an improved cover assembly to extend across gaps or openings between spaced-apart structural members to protect the expansion joint from degradation and to provide a smooth transition across the expansion joint opening.

SUMMARY

Provided is a cover assembly for a gap between structural members comprising at least one base member affixed to said structural members, a coverplate comprising an elongated resilient cover having a load bearing surface opposite a support surface and a rigid plate member bridging said gap between said structural members and engaged with said elongated resilient cover; and a positioning assembly engaged with said coverplate and base member.

Also provided is an expansion joint for a building structure comprising two spaced structural members defining a gap therebetween, at least one base member affixed to said structural members, a coverplate comprising an elongated resilient cover having a load bearing surface opposite a support surface and a rigid plate member bridging said gap between said structural members engaged with said elongated resilient cover; and a positioning assembly engaged with said rigid plate and base member.

DETAILED DESCRIPTION

Figure 1:
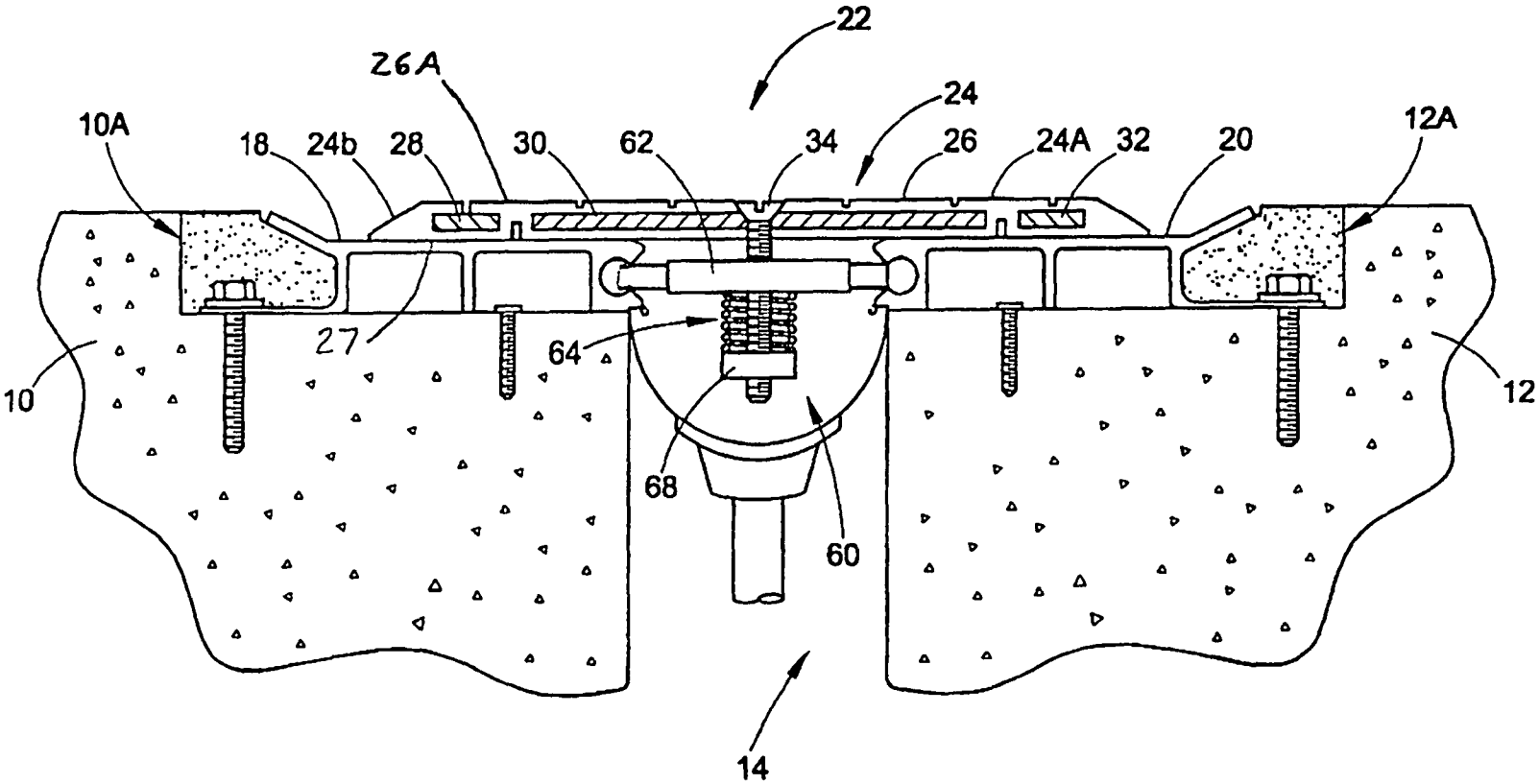
FIG. 1 is an elevational view in section of an illustrative embodiment of the assembly.

Provided is a cover assembly for bridging a gap or opening between structural members. The cover assembly has the resiliency to conform to the configuration of support sites provided by underlying structural members. In general, the cover assembly comprises one or more base members that are affixed to underlying horizontal structural members, a positioning member that is engaged with the one or more base members, an elongated resilient cover having a traffic bearing surface opposite a support surface, and at least one rigid plate member engaged with the cover and the positioning member. The cover assembly also includes one or more mechanical fasteners at spaced apart sites along the resilient cover for engaging the base member to the positioning member.

Also provided is an expansion joint for a building structure. The expansion joint includes spaced-apart adjacent structural members defining a gap or opening therebetween. A cover assembly is secured across the expansion joint to protect the expansion joint and to provide a smooth transition of pedestrian or vehicular traffic across the expansion joint. The cover assembly comprises one or more base members that are affixed to the underlying spaced-apart structural members. A positioning member is engaged with the one or more base members that are affixed to the structural members. The cover assembly comprises a coverplate including an elongated resilient cover having a traffic bearing surface opposite a support surface. The support surface includes marginal support areas along opposite lateral edges thereof. The cover assembly also includes at least one rigid plate member that is engaged with the elongated resilient cover for bridging the gap between the underlying base members. The cover assembly also includes one or more fasteners at spaced apart sites along the resilient cover for engaging the base member to the positioning member.

The rigid plate member of the coverplate has a width sufficient to bridge the gap between the two underlying structural members. According to certain embodiments, additional plate members may be engaged with the resilient cover and serve to urge the opposite lateral edges of the cover into supporting engagement with the base members.

The resilient cover has a thickness and sufficient elasticity to elastically deform for establishing supporting contact between the marginal support areas of the cover and the underlying base members. Without limitation, suitable elastomeric materials used to prepare the resilient cover include styrene-butadiene rubber (SBR), butadiene rubber (BR), butyl rubber, ethylene-propylene rubber (EPM), ethylene-propylene-diene rubber (EPDM), polyisoprene rubber, polychloroprene rubber, various ethylene-alkene copolymer rubbers, silicon rubber, nitrile rubber, and combinations thereof.

According to certain embodiments, ethylene-propylene-diene rubber (EPDM) is utilized to prepare the resilient cover of the coverplate. A particularly suitable EPDM rubber composition that is useful to prepare the resilient cover is commercially available from Advanced Elastomer Systems, L.P. (Akron, Ohio) under the trade name SANTOPRENE®.

The base members of the cover assembly are fixedly or removably engaged with the upper surfaces of the underlying structural members along the peripheral margins (or edges) of the structural members, which define the boundaries of the gap between the structural members.

The cover assembly includes at least one rigid plate member that is engaged with the resilient elastomeric cover. The rigid plate member has a width sufficient to span the width of the expansion joint opening located between spaced-apart structural members. According to certain embodiments, the rigid plate is engaged with the resilient elastomeric cover by encapsulating the rigid plate within the elastomeric cover material. Alternatively, the rigid plate may be secured to the underside support surface of the resilient elastomeric cover by any suitable means, such as by mechanical fasteners or adhesives.

In addition to the rigid plate that spans the expansion joint opening between the spaced-apart structural members, the cover assembly may also include additional rigid plate members engaged with the resilient elastomeric cover that extend in a side-by-side relationship on opposite lateral sides of the rigid plate that spans the expansion joint opening. These additional rigid plate members may be engaged with the resilient elastomeric cover in the same manner as the rigid plate member that spans the expansion joint opening. The further inclusion of additional plate members located on opposite lateral sides of the rigid plate member allows for elastic deformation of the resilient cover and applies a biasing force in a direction to urge opposite lateral sides of the cover toward the horizontal structural members when resiliently deformed by traffic traversing said load bearing surface.

The cover assembly also includes a positioning assembly that is engaged with the base member(s) and the coverplate. The positioning assembly can be used to maintain a substantially centered position of the coverplate within the expansion joint gap between spaced-apart structural members, and to provide a smooth transition across the gap.

Fasteners are engaged with the coverplate at spaced apart sites along a portion thereof for anchoring the coverplate to the positioning assembly. The positioning member may be positioned between the peripheral margins of the expansion joint and engaged with a base member on each side of the gap between the structural members. Without limitation, the positioning member maintains the coverplate substantially centered over the opening of the expansion joint.

Also provided is a method for the installation of a cover assembly for a gap between two structural members. The method includes providing at least one base member and engaging the base member(s) with the upper surfaces of the spaced-apart structural members along the peripheral margins (or edges) of the structural members which define the boundaries of the gap. The method further includes locating the positioning member between the peripheral margins of the expansion joint opening and engaging it with the base member. The support surfaces of the elongated resilient cover of the coverplate, and having a rigid plate engaged therewith, is brought into contact with the upper surfaces of the underlying structural members. The coverplate is engaged with the positioning member by at least one fastener.

Figure 2:
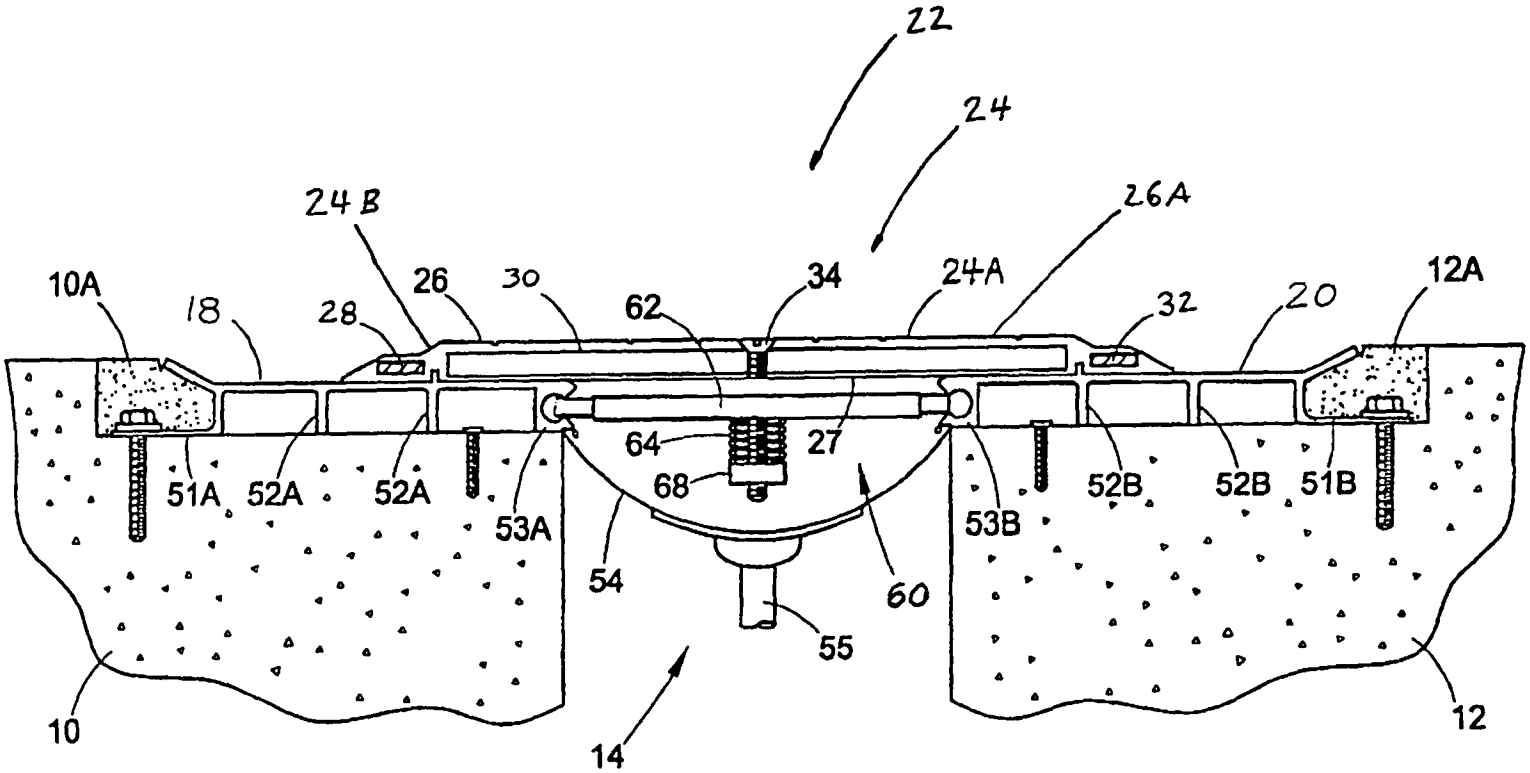
FIG. 2 is an elevational view in section of another illustrative embodiment of the assembly.
Figure 3:
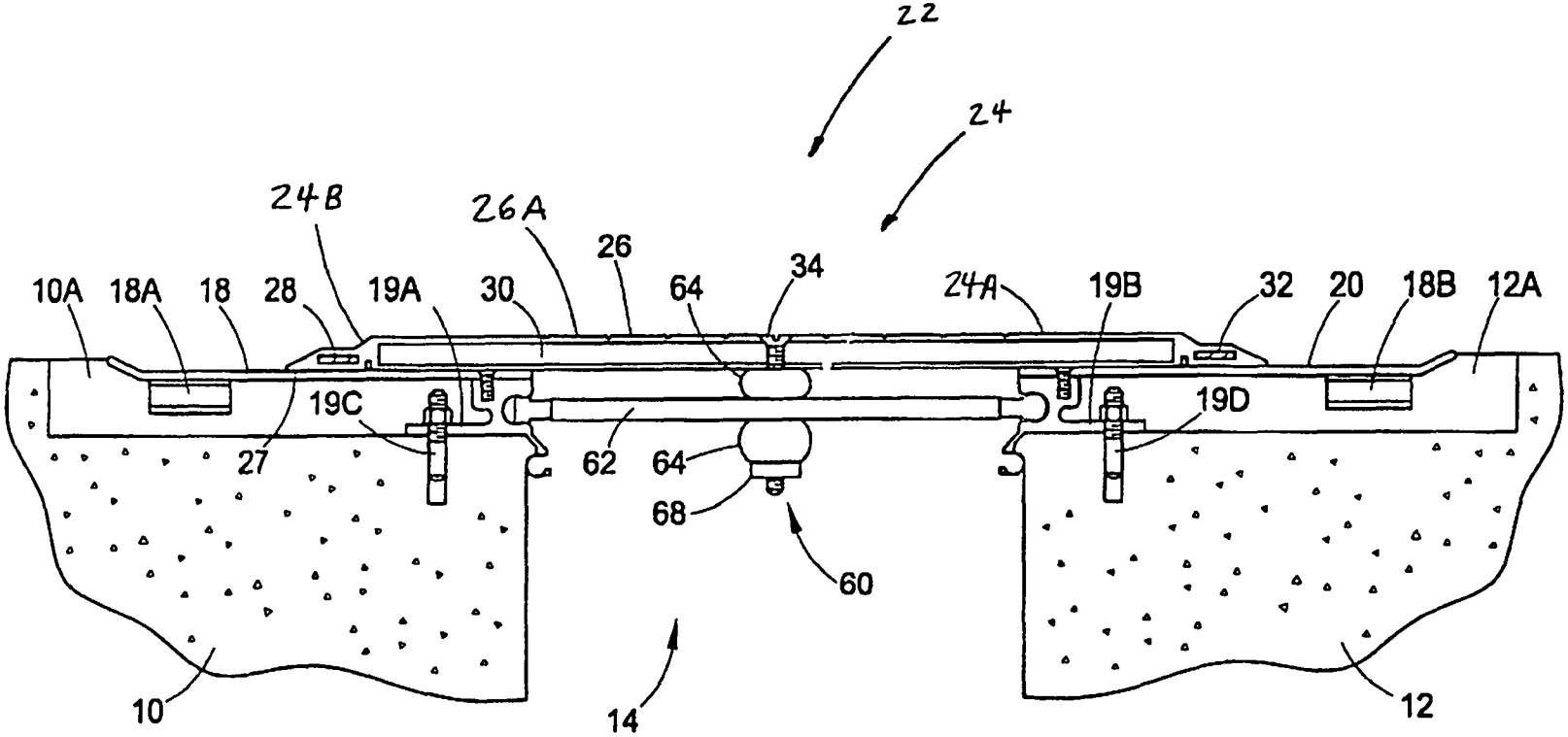
FIG. 3 is an elevational view in section of yet another illustrative embodiment of the assembly.

According to the illustrative embodiments shown in FIGS. 1-3, structural members 10 and 12 are separated by a gap 14. The structural members 10 and 12 may be precast slabs used to form passageways for both vehicle and pedestrian traffic. The structural members 10 and 12 are supported by underlying superstructure (not shown). In the embodiments shown, the structural members 10 and 12 have material removed to provide spacing for accepting the base members 18 and 20. The area defined by the removed material is often referred to in the industry as a "block out". The block out regions are identified as 10A and 12A in structural members 10 and 12, respectively. In certain embodiments, the removal of material allows the base members to be at least partially recessed within the structural members. In certain embodiments, recession of the base members decreases the overall height difference between the fully installed cover assembly and that of the upper traffic bearing surfaces of the underlying horizontal structural members.

Base members 18 and 20 provide an interface between the structural members 10 and 12 and other components of the cover assembly. The base members 18 and 20 engage the positioning member 60 and support the elongated coverplate 24. As shown in FIGS. 1 and 2, each of the base members 18 and 20 may be provided as a single unitary part. According to FIG. 3, each of the base members 18 and 20 may be composed of a plurality of parts or sub-assemblies. According to the embodiment shown in FIG. 3, the parts or sub-assemblies composing the base members may be joined by fasteners or adhesives or other means.

The base members have strength to support elements placed upon them as well as the loads imparted to those elements by traffic. The base members may be comprised of a material of strength sufficient to the withstand forces which may be applied to the base members. These forces will depend upon the particular application and can be readily determined by the skilled artisan. Without limitation, suitable materials that may be used to manufacture the base members of the cover assembly include metals, metal alloys and polymers.

According to the embodiment shown in FIGS. 1-3, the base members comprise a top surface upon which additional elements may be positioned or reposed for support by the base members. The base members comprise a bottom surface or surfaces, which are positioned in contact with supporting regions of the underlying structural members. The surfaces positioned in contact with supporting regions of the structural members may include the plates, ribs, or other structures. According to the embodiments shown in FIG. 3, base members may include structures intended to promote connection with an adhesive or elastomeric concrete. In certain embodiments, the base members comprise a bottom surface or surfaces which are positioned in contact with an adhesive or cementitious composition which acts as the interface between the base members and the underlying structural members.

Alternatively, the base members are attached to the structural members with mechanical fasteners. The mechanical fasteners may comprise anchors, bolts, nails, rivets, screws, tacks and the like. In certain embodiments, the base members are attached to the structural members with elastomeric concrete. In certain embodiments, the base members include alignment slots.

The base members include a suitable cavity, housing, notch, passage, recess, slot, track, rail, pin, groove, or other feature to which the positioning member may be engaged. In certain embodiments, the base members include a member to engage a cavity, housing, notch, passage, recess, slot, track, rail, pin, groove, or other feature to which a cavity, housing, notch, passage, recess, slot, track, rail, pin, groove, or other feature of the centering assembly may be engaged.

According to the embodiments shown in FIGS. 1-3, the positioning member 60 provides an interface between the base elements 18 and 20 and the coverplate 24. The positioning member 60 is positioned in the gap 14 between the structural members 10 and 12. The positioning member 60 comprises a coverplate positioning member 62 having at least two ends, at least one resistance element 64, and optionally a retention element 68. According to the embodiments shown in FIGS. 1 and 2, the positioning member 60 includes one resistance element 64, which is comprised of a wire coil spring. According to an alternative embodiment shown in FIG. 3, the positioning member includes two resistance elements 64, which are comprised of elastomeric springs.

The resilient coverplate positioning member 62 is an element which transmits forces between the base members 18 and 20 and one or more resistance elements 64. Member 62 is engaged with base elements 18 and 20. The engagement allows each end of member 62 to translate along a path defined by the base member retaining that particular end. The engagement substantially permits rotation of member 62. As of a result of this manner of engagement, member 62 end portions slide along the paths defined their respective base members in response to changes in the Width of the gap. The sliding of the end portions of member 62 end portions results in rotation of member 62.

During contraction of the gap 14, the distance between the end portions of member 62 is decreasing in the longitudinal direction but equilibrium is maintained by increasing the distance between end portions of member 62 in either the transverse direction, the vertical direction, or both, such that member 62 need not change in length. During expansion of the gap 14, the distance between the end portions of member 62 is increasing in the longitudinal direction but equilibrium is maintained by decreasing the distance between end portions of member 62 in either the transverse direction, the vertical direction, or both, such that member 62 need not change in length. The type of track, slot, track, rail, pin, groove, or other feature defines the path along which the end of member 62 will translate in response to changes in the width of the gap. In certain embodiments, the connection between the base members 18 and 20 and member 62 comprises a female track in the base member and a male shuttle at the end of member 62. Alternatively, the tracks in the base members are linear, parallel to one another, and parallel to the traffic bearing surface. In certain embodiments, the male shuttles at the ends of member 62 are substantially spherical or cylindrical, and are adapted to slide within a female track. An end of member 62 may be spherical and adapted to slide within a female track of circular cross-section in its associated base member, while the other end of member 62 may be of a different shape and adapted to slide within a female track of circular cross-section in its associated base member.

Resistance elements 64 are positioned between facing surfaces of member 62 and the retention element 68, or between member 62 and the retention element 68 and between member 62 and coverplate 24. As shown in FIG. 1 and FIG. 2, one resistance element 64 is positioned between member 62 and the retaining element 68. In the embodiment shown in FIG. 3, there is one resistance element 64 between member 62 and the retaining element 68 and one resistance element 64 between member 62 and the coverplate 24. A resistance element 64 can be any element which produces a restorative resistance force when displaced. As shown in FIG. 1 and FIG. 2, the resistance element 64 is a cylindrical coil compression spring. In such embodiments, the coil may be composed of a metal or a polymer or both. In another embodiment, shown in FIG. 3, the resistance elements 64 are elastomeric spring bearings. Without limitation, elastomeric spring bearings may include polyurethane, silicone, or other elastomeric material. In certain embodiments, the resistance element 64 may include cylindrical coil springs, non-cylindrical coil springs, leaf springs, elastomeric springs, elastomeric bushings, gas springs, spring bearings, and combinations thereof.

The retention element 68 retains the anchoring fastener 34 and provides a connection or engagement between the anchoring fastener 34 and the positioning member 60. The retention element 68 has means for engagement with the anchoring fastener 34. The means for engaging the retention element 68 with the fastener 34 may include threaded connections, adhesives, welds, solders, mechanical fasteners, press fits, hooks, and combinations thereof. The means for engagement with the anchoring fastener 34 may comprise a female threaded hole adapted to accept a male threaded anchoring fastener 34. The retention element 68 serves as an element against which the forces from the resistance elements 64 may act and through which forces may be transmitted to the anchoring fastener 34. The retention element may take a variety of forms including but not limited to a circular disk, a rectangular plate, a sphere, a cylinder, and a cone.

The positioning member 60 transmits forces which displace the resistance element or elements in response to displacement of the coverplate 24. The compression or extension of the resistance element 64 or elements creates restorative resistance forces, which act through the positioning member 60 to apply forces to the coverplate 24 in order to maintain or restore the contact between the underside of coverplate 24 and the top surfaces of the base elements 18 and 20.

The coverplate 24 of the cover assembly 22 includes an elongated resilient cover 24A placed to extend along opposite lateral sides of the gap 14 between the base members 18 and 20. The cover 24A has a predetermined length suitably selected to allow convenient handling and installation and a series of covers 24A may be arranged in an end-to-end relationship to protect the entire length of an extended gap. As shown by the contrast between FIG. 1 and FIG. 2, the geometry of the elongated resilient cover 24A may be changed to adapt it to different conditions.

The cover 24A comprises a flexible, elastic strip-like member having an substantially upwardly directed load bearing face surface 26. The load bearing face surface 26 comprises spaced apart upstanding ribs 26A arranged to extend transversely to the direction of traffic for improved traction. Opposite the upwardly directed load bearing face surface 26, is the substantially downwardly directed support surface 27. The support surface 27 engages with a supporting surface on each base member. The opposite lateral terminal edges of the cover have tapered face surfaces 24B for providing inclined planes for smoothing the transition from the traffic bearing surface of one of the structural members 10 and 12 to the cover 22 and then from the cover 22 to the traffic bearing surface of one of the structural members 10 and 12.

As shown in FIGS. 1-3, three spaced apart, substantially parallel, plate members 28, 30 and 32 are encapsulated within the elastomeric cover 24A. The plate member 30 is located at a substantially central position to overlie the gap 14 and protect the gap 14 and the edges of structural members 10 and 12 by forming a bridge to transfer the forces from traffic to the upper surfaces of structural members 10 and 12. Plate members 28 and 32 are optional and provide structure and resiliency to hold the tapered face surfaces 24B in contact with the base members 18 and 20. The plate members may be joined to the elastomeric cover 24A by means selected from the group consisting of full encapsulation, partial encapsulation, adhesives, mechanical fasteners, or combinations thereof. Suitable mechanical fasteners include, but are not limited to, nails, screws, tacks, bolts and rivets. The mechanical fasteners can be made from metal or a polymeric material. The rigid plate members may be rolled steel, stainless steel, galvanized steel, aluminum plates, or other materials of strength appropriate to the forces to which the plate members will be exposed. These forces will depend upon the particular application and can be readily determined by the skilled practitioner. In certain embodiments, all of the rigid plate members are composed of the same material. In certain embodiments, the plate members galvanized steel plates.

In certain embodiments, the elongated resilient cover 24A is constructed of elastomeric material containing fillers and a plasticizer to yield a rubber material having a Type A Shore Durometer of about 70 or greater. The term "elastomeric" refers to a material that possesses rubber-like properties, for example, an elastomeric material will substantially recover its original dimensions after compression and/or elongation. Any elastomeric material may be used to prepare the resilient cover 24A of coverplate 24, so long as the cover 24A can be prepared to a thickness and sufficient elasticity to elastically deform to establish supporting contact between the marginal support areas of the cover assembly and the underlying horizontal structural members to provide a smooth transition over the gap or opening for pedestrian or vehicular traffic.

The cover 24A comprises an elastic material, such that spaced apart fastener receptacle holes are uninhibited from elastic deformation to prevent dislodgment and breakage of the fasteners. The elastic construction of the cover permits elastic conformation into supporting contact with the underlying support structures, which can have irregular configurations without the loss of supporting contact. This insures stability to the cover which is enhanced by the weight represented by the mass of the plates 28, 30 and 32.

One or more fasteners 34 extend through suitable openings arranged at spaced apart locations along the resilient cover 24A and each fastener further extends into a positioning member 60. Fasteners 34 may include screws, bolts, rivets, and the like.

According to the embodiments shown in FIG. 1 and FIG. 2, the cover assembly may include an optional moisture barrier spanning the gap 14. The moisture barrier shields the underside of the cover assembly from moisture and debris. A drainage tube may be incorporated with the moisture barrier to facilitate drainage of materials which may invade the shielded volume.

Still referring to FIG. 1, there are two structural members 10 and 12 with a gap 14 between them. Each structural member 10 and 12 has a block out 10A and 12A. Engaged with each structural member 10 and 12 within the block out is a base member 18 and 20. Each of the base members shown have supporting regions which include a broad plate region, a rib, and the bottom edge of a track element. The base members 18 and 20 are attached to the structural members 10 and 12 with concrete bolts and elastomeric concrete. Both base members 18 and 20 include a female track with a circular cross-section. Engaged with the base members 18 and 20 by this female track is the positioning member 60. The element of the positioning member 60 which is in contact with the base members 18 and 20 by the female track comprises member 62. As shown in FIG. 1, member 62 has one end which is substantially spherical and engages with the female track in the base member 20 at its end and another end which is substantially cylindrical and engages with the female track in the base member 18 at its end. Member 62 has a clearance hole (not shown) through which a male threaded fastener 34 extends as it passes from the coverplate 24 to the retaining element 68. In the embodiment shown in FIG. 1, a resistance element 64 is in contact with the underside of member 62 and surrounds the fastener 34. In the embodiment shown in FIG. 1, the retaining element 68 has a female threaded hole to engage the male threaded fastener 34 so that forces may be transmitted between the male threaded fastener 34 and the retaining element 68.

The elongated resilient cover of coverplate 24 has a traffic bearing surface 26 opposite a support surface 27. The elongated resilient cover 24A includes marginal support areas along opposite lateral edges thereof, a first rigid plate member 30 for bridging a gap 14 between two base members 18 and 20, and two additional rigid plate members 28 and 32 that are engaged with the elongated resilient cover 24 to extend along opposite lateral sides of the first rigid plate member 30. The first rigid plate member 30 and the two additional rigid plate members 28 and 32 are shown encapsulated within the elongated resilient cover 24A. The support surface 27 of the elongated resilient cover 24A is shown in contact with and is supported by the base members 18 and 20. Also, the coverplate 24 is engaged with the positioning member 60 by the fastener 34. A moisture barrier and a drainage tube is installed across the gap 14 below the positioning member 60.

According to the embodiment shown in FIG. 2, there are two structural members 10 and 12 with a gap 14 between them. Each structural members 10 and 12 has a block out region denoted by 10A and 12A. Engaged with each structural member 10 and 12 within the block out is a base member 18 and 20. Each of the base members 18 and 20 shown have supporting regions which include flange regions 51A, 51B, ribs 52A, 52B, and track elements 53A, 53B. The base members 18 and 20 are attached to the structural members 10 and 12 with concrete bolts and elastomeric concrete. Both base members 18 and 20 have a female track with a circular cross-section. Engaged with the base members 18 and 20 by this female track is the positioning member 60. The element of the positioning member 60 which engages the base members 18 and 20 via the female tracks is coverplate positioning member 62.

As shown in FIG. 2, member 62 has one end which is substantially spherical and engages with the female track in the base member 20 at its end and another end which is substantially cylindrical and engages with the female track in the base member 18 at its end. In the embodiment shown in FIG. 2, member 62 has a clearance hole (not shown) through which a male threaded fastener 34 extends as it passes from the cover to the retaining element 68. A resistance element 64 is in contact with the underside of member 62 and surrounds the fastener 34. At the other end of the resistance element 64, it is in contact with a retaining element 68. The retaining element 68 includes a female threaded hole to engage the male threaded fastener 34 so that forces may be transmitted between the male threaded fastener 34 and the retaining element 68. The elongated resilient cover 24A has a traffic bearing surface 26 opposite a support surface 27. The elongated resilient cover 24A includes marginal support areas along opposite lateral edges thereof, a first rigid plate member 30 for bridging a gap 14 between two base members 18 and 20, and two additional rigid plate members 28 and 32 that are engaged by the elongated resilient cover 24A to extend along opposite lateral sides of the first rigid plate member 30. The first rigid plate member 30 and the two additional rigid plate members 28 and 32 are shown encapsulated within the resilient cover 24A of the coverplate 24. The support surface 27 of the elongated resilient cover 24A is shown in contact with and is supported by the base members 18 and 20. Also, the elongated resilient cover 24A is engaged with the positioning member 60 by the fastener 34. A moisture barrier 54 and a drainage tube 55 installed across the gap 14 below the positioning member 60.

According to the embodiment shown in FIG. 3, there are two structural members 10 and 12 with a gap 14 between them. Each structural members 10 and 12 has a block out region 10A and 12A. Engaged with each structural member 10 and 12 within the block out is a base member 18 and 20. Each of the base members 18 and 20 shown have supporting regions which include a plate region. As shown in FIG. 3, the base members 18 and 20 include structures 18A and 20A intended to promote connection with an adhesive or elastomeric concrete. The base members 18 and 20 are attached to track members 19A, 19B. In turn, track members 19A, 19B are attached to the structural members 10 and 12 with expansion bolts 19C, 19D and elastomeric concrete. Both base members 18 and 20 are engaged with a female track 19A, 19B having a circular cross-section. Engaged with the base members 18 and 20 by this female track is the positioning member 60. As shown in FIG. 3, member 62 has one end which is substantially spherical and engages with the female track 19B of the base member 20 at its end and another end which is substantially cylindrical and engages with the female track 19A in the base member 20 at its end. Member 62 has a clearance hole (not shown) through which a male threaded fastener 34 extends as it passes from the cover to the retaining stud 68. A resistance element 64 is in contact with the underside of member 62 and surrounds the fastener 34. At the other end of the resistance element 64, it is in contact with a retaining element 68. In the embodiment shown in FIG. 3, the retaining element 68 has a female threaded hole to engage the male threaded fastener 34 so that forces may be transmitted between the male threaded fastener 34 and the retaining stud 68. The elongated resilient cover 24A has a traffic bearing surface 26 opposite a support surface 27. The elongated resilient cover 24A includes marginal support areas along opposite lateral edges thereof, a first rigid plate member 30 for bridging a gap 14 between two base members 18 and 20, and two additional rigid plate members 28 and 32 that are engaged by the elongated resilient cover 24A to extend along opposite lateral sides of the first rigid plate member 30. The first rigid plate member 30 and the two additional rigid plate members 28 and 32 are shown encapsulated within the elongated resilient cover 24A. The support surface 27 of the elongated resilient cover 24 is shown in contact with and is supported by the base members 18 and 20. Also, the coverplate 24 is engaged with the positioning member 60 by the fastener 34.

It should be noted that the cover assembly can be used to bridge an opening or gap between any two structural members to promote a smooth traffic transition between the two structural members. The cover assembly is useful to bridge an opening or gap between horizontally offset members, vertically offset structural members, or members which are both horizontally and vertically offset (horizontally/vertically offset). By way of illustration, and without limitation, the cover assembly can be used to bridge structural members, such as concrete slabs, which are designed to be horizontally/vertically offset or that may become horizontally/vertically offset due to differential concrete settlement or other displacement.

In situations where there is a more severe vertical offset or slope between two opposing concrete members or slabs, the rigid plate member that bridges the gap between the opposing structural members can include a permanent bend. Providing a bend in the rigid plate member provides a more smooth transition between the opposing structural members having a severe vertical offset for vehicular and pedestrian traffic.

As described hereinabove, it is known that surface of concrete structural members are often not entirely uniform, and are often not produced with square or smooth surfaces. These concrete structural members are often rough, often have substantially irregular or undulating gaps, and sometimes are missing entire chunks of concrete. Metal plates have been traditionally used in cover plate assemblies, but cannot conform to the contours of the concrete structural members and, therefore, a potential hazard exists for pedestrian and vehicular traffic. An embodiment of the cover assembly may prepared from an elastomeric resilient material than can be elastically deformed in response to a load applied to it to conform to the irregular or undulating contours present often found in structural members. The cover assembly may provide a means for a smooth the transition across the irregular surfaces of the structural members and to substantially eliminate the hazards associated with the irregular surface of structural members, such as concrete slabs.

In certain embodiments, the cover assembly can be used as a temporary expansion joint cover during construction of building structures to allow for a smooth passage of construction workers and equipment across the expansion joints in a building structure.

While the cover assembly has been described in connection with certain illustrative embodiments, as shown in the various figures, it is to be understood that other similar embodiments may be used or modifications and additions may be made to the described embodiments for performing the same function without deviating therefrom. Furthermore, the various illustrative embodiments may be combined to produce the desired results. Therefore, the cover assembly should not be limited to any single embodiment, but rather construed in breadth and scope in accordance with the recitation of the appended claims.

We claim:

1. A cover assembly for a gap between structural members comprising:

at least one base member affixed to at least one of said structural members;

a coverplate comprising:

an elongated resilient cover having a load bearing surface opposite a support surface; and a plurality of spaced apart rigid plate members engaged with said elongated resilient cover;

wherein one of said plurality of spaced apart rigid plate members comprises a gap bridging rigid plate member which bridges said gap between said structural members;

wherein the remainder of said plurality of spaced apart rigid plate members extend along opposite lateral sides of said gap bridging rigid plate member for allowing elastic deformation of said elongated resilient cover; and wherein the elongated resilient cover is capable of applying a biasing force in a substantially vertical direction to urge said rigid plate members which extend along opposite lateral sides of said gap bridging rigid plate member cover toward the horizontal structural members while the elongated resilient is resiliently deformed by traffic traversing said load bearing surface; and a positioning assembly which comprises a rotatable member which is engaged to said coverplate and said at least one base member.

2. The cover assembly of claim 1, wherein said elongated resilient cover comprises peripheral edges including tapered face surfaces for providing incline planes to bear traffic traversing said elongated resilient cover.

3. The cover assembly of claim 1, wherein said load bearing surface of said elongated resilient cover includes spaced apart upstanding ribs arranged to extend transversely to the direction of traffic traversing said cover.

4. The cover assembly of claim 1, further comprising mechanical fasteners for engaging said coverplate to said positioning assembly, and wherein said fasteners are selected from the group consisting of screws, bolts, nails, rivets and combinations thereof.

5. The cover assembly of claim 1, wherein said elongated resilient cover comprises an elastomeric material.

6. The cover assembly of claim 5, wherein said elastomeric material is selected from the group consisting of butadiene rubber, styrene-butadiene rubber, butyl rubber, ethylene-propylene rubber, ethylene-propylene-diene rubber, polyisoprene rubber, polychloroprene rubber, silicone rubber, nitrile rubber and combinations thereof.

7. The cover assembly of claim 6, wherein said elastomeric material comprises ethylene-propylene-diene rubber.

8. The cover assembly of claim of claim 7, wherein said plurality of spaced apart rigid plate members of said coverplate are encapsulated within said ethylene-propylene-diene rubber cover.

9. The cover assembly of claim 1, wherein said positioning assembly further comprises a resistance element and a retention element.

10. The cover assembly of claim 9, wherein said resistance element is selected from the group consisting of compression springs, leaf springs, elastomeric springs, elastomeric bushings, gas springs, spring bearings, and combinations thereof.

11. The cover assembly of claim 10, wherein said resistance element comprises a compression spring.

12. The cover assembly of claim 1, wherein said base members comprise aluminum extrusions;

wherein said elongated resilient cover comprises ethylene-propylene-diene rubber;

wherein said positioning assembly comprises a rotatable coverplate positioning member, a steel compression spring and a retention nut; and wherein said coverplate is engaged to said positioning assembly by at least one fastener.

13. The cover assembly of claim 12, wherein said at least one fastener comprises at least one bolt engaged with said coverplate.

14. The cover assembly of claim 13, wherein said at least one fastener is engaged substantially along the median portion of said coverplate.

15. An expansion joint for a building structure comprising:

two spaced structural members defining a gap therebetween;

at least one base member affixed to at least one of said structural members;

a coverplate comprising:

an elongated resilient cover having a load bearing surface opposite a support surface; and a plurality of spaced apart rigid plate members engaged with said elongated resilient cover;

wherein one of said plurality of spaced apart rigid plate members comprises a gap bridging rigid plate member which bridges said gap between said structural members;

wherein the remainder of said plurality of spaced apart rigid plate members extend along opposite lateral sides of said gap bridging rigid plate member for allowing elastic deformation of said elongated resilient cover; and wherein the elongated resilient cover is capable of applying a biasing force in a substantially vertical direction to urge said rigid plate members which extend along opposite lateral sides of said gap bridging rigid plate member toward the horizontal structural members while the elongated resilient cover is resiliently deformed by traffic traversing said load bearing surface; and a positioning assembly which comprises a rotatable member which is engaged with said coverplate and at least one base member.

16. The expansion joint of claim 15, wherein said elongated resilient cover comprises peripheral edges including tapered face surfaces for providing incline planes to bear traffic traversing said elongated resilient cover.

17. The expansion joint of claim 15, wherein said load bearing surface of said elongated resilient cover includes spaced apart upstanding ribs arranged to extend transversely to the direction of traffic traversing said cover.

18. The expansion joint of claim 15, further comprising mechanical fasteners for engaging said coverplate to said positioning assembly, and wherein said fasteners are selected from the group consisting of screws, bolts, nails, rivets and combinations thereof.

19. The expansion joint of claim 15, wherein said elongated resilient cover comprises an elastomeric material.

20. The expansion joint of claim 19, wherein said elastomeric material is selected from the group consisting of butadiene rubber, styrene-butadiene rubber, butyl rubber, ethylene-propylene rubber, ethylene-propylene-diene rubber, polyisoprene rubber, polychloroprene rubber, silicone rubber, nitrile rubber and combinations thereof.

21. The expansion joint of claim 20, wherein said elastomeric material comprises ethylene-propylene-diene rubber.

22. The expansion joint of claim 21, wherein said plurality of spaced apart rigid plate members of said coverplate are encapsulated by said elongated resilient cover.

23. The expansion joint of claim 15, wherein said positioning assembly further comprises a resistance element and a retention element.

24. The expansion joint of claim 13, wherein the resistance element is selected from the group consisting of compression springs, leaf springs, elastomeric springs, elastomeric bushings, gas springs, spring bearings, and combinations thereof.

25. The expansion joint of claim 24, wherein the resistance element comprises a compression spring.

26. The cover assembly of claim 15, wherein said base members comprise aluminum extrusions;

wherein said elongated resilient cover comprises ethylene-propylene-diene rubber;

wherein said positioning assembly comprises a rotatable coverplate positioning member, a steel compression spring and a retention nut; and wherein said coverplate is engaged with said positioning assembly by at least one fastener.

27. The expansion joint of claim 26, wherein said at least one fastener comprises at least one bolt engaged to said coverplate.

28. The expansion joint of claim 27, wherein said at least one fastener is engaged substantially along the median portion of said coverplate.

* * * * *